United States Patent [19]

Ishida

[11] 4,090,418

[45] May 23, 1978

[54] DEVICE FOR REFORMING AND GRINDING THE BLADE OF A KNIFE TO BE SHARPENED

[76] Inventor: Shigeyoshi Ishida, 6-10, Dojojuku, Utsunomiya City, Tochigi Pref., Japan

[21] Appl. No.: 746,692

[22] Filed: Dec. 2, 1976

[30] Foreign Application Priority Data

Feb. 28, 1976 Japan ..... 51-23878

[51] Int. Cl.[2] ..... B21K 11/02

[52] U.S. Cl. ..... 76/84; 76/89; 51/210

[58] Field of Search ..... 76/89, 84, 88; 29/78 R; 51/210

[56] References Cited

U.S. PATENT DOCUMENTS

| | | | |
|---|---|---|---|
| 719,880 | 2/1903 | Rose | 76/89 |
| 1,158,048 | 10/1915 | Hawks | 76/88 |
| 1,388,882 | 8/1921 | Paul | 51/210 |
| 2,896,482 | 7/1959 | Hyde | 76/84 |

*Primary Examiner*—Harold D. Whitehead
*Assistant Examiner*—Roscoe V. Parker
*Attorney, Agent, or Firm*—James E. Nilles

[57] ABSTRACT

A device for reforming and grinding the blade of a knife to be sharpened comprising a supporting rod, a grinding plate having a plurality of concentric triangular projections at the both sides thereof, and guide disks arranged at the both sides of said grinding plate. A clearance into which the blade of a knife is inserted is provided between said grinding plate and guide disk.

11 Claims, 6 Drawing Figures

DEVICE FOR REFORMING AND GRINDING THE BLADE OF A KNIFE TO BE SHARPENED

The present invention relates to a device for reforming and grinding the blade of a knife to be sharpened.

In case of reforming and grinding the blade of a knife to be sharpened by using a conventional rod file, there is a danger of harming a hand by the knife because it is difficult to maintain the rod file at a suitable angle with respect to the blade of the knife and to move the rod file with stability. It requires a great deal of skill for handling such a rod file. Further, a device for reforming and grinding the blade of a knife by shifting the blade with respect to the device has a defect such that the blade becomes serrated.

An object of the present invention is to provide a device for reforming and grinding the blade of a knife to be sharpened in which said defects can be eliminated.

The present invention provides a device for reforming and grinding the blade of a knife to be sharpened comprising a supporting rod, a grinding plate rotatably supported by said supporting rod and having a plurality of concentric triangular projections at both sides thereof, and guide disks arranged rotatably at both sides of said grinding plate with a clearance space therebetween.

The present invention further provides a device for reforming and grinding the blade of a knife to be sharpened comprising a supporting rod having a notch portion at the center thereof, a stop having a cylindrical body with a central opening and a circumferential groove, a cutout portion in said groove communicating with said central opening, a plate spring attached at said cutout portion and fixed on said cylindrical body, and a hollow cylindrical cover into which said cylindrical body is inserted and fixed thereto, said plate spring being engaged with said notch portion of said supporting rod to thereby prevent the stop from being moved in the axial direction of said supporting rod.

According to the present invention, when the knife blade becomes blunt, it is pressed down, first between the grinding plate and one guide disk and then between the grinding plate and the other guide disk, alternatively, and slid in one direction. During its sliding operation the blade is suitably guided by the guide disks and the grinding plate in a space therebetween, so that both sides of the blade are reformed over its whole surfaces while being ground a little thereby removing adhesives such as grease adhered, thus permitting it to be sharpened.

Further, according to the present invention, the knife blade is smoothly guided by the rotary guide disks and the grinding plate, so that the reforming and grinding of the knife blade can be effectively accomplished by a small force, and thus enabling the sharpening operation of the knife blade to be quickly attained. Anyone is able to handle the device easily without any skill and the time and labor saved enhance the operational efficiency.

Moreover, according to the present invention, the device can attain such effects that safety is guaranteed, the amount which the knife blade is ground is so small that the life of the knife can be extended, and the device can be small-sized and compact and can be manufactured more easily and cheaply.

Other object and features of the present invention will be apparent from the following description with reference to the accompanying drawings, in which.

Figure 1:
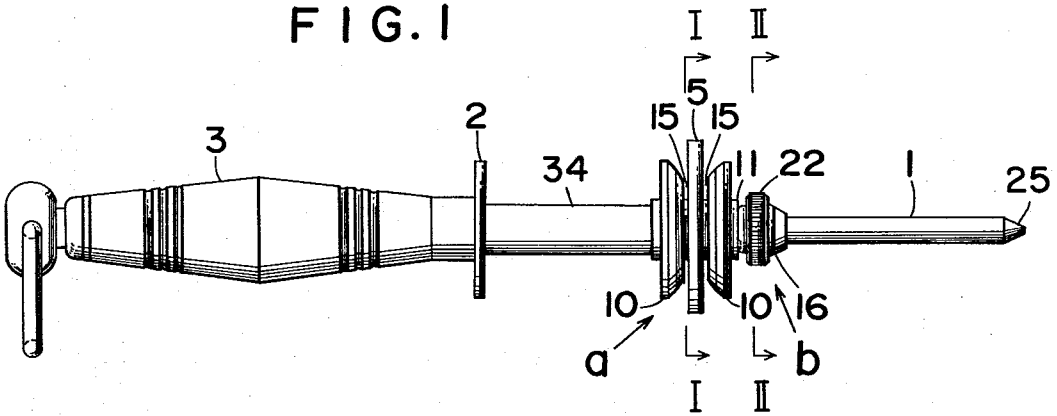
FIG. 1 is a front view showing an embodiment of the present invention.
Figure 6:
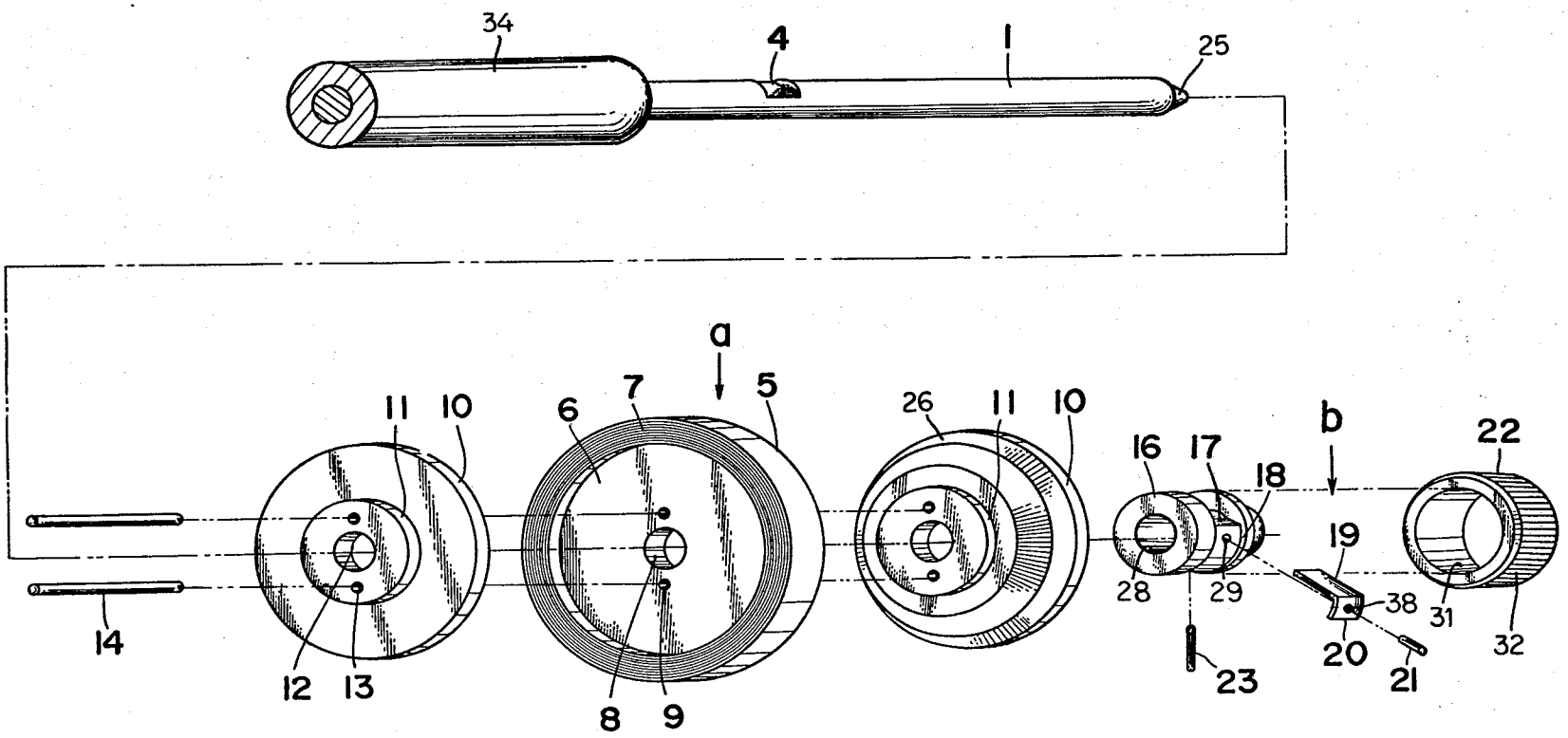
FIG. 6 is a schematic perspective exploded view of the embodiment.

A device for reforming and grinding the blade of a knife to be sharpened of the present invention has a supporting rod 1, at the base portion of which is fixed a handle 3 via a collar 2 for a safety guard and at the center portion of which is provided a notch portion 4, as shown in FIGS. 1 and 6. The front portion 25 of said supporting rod 1 is formed conically.

Figure 3:
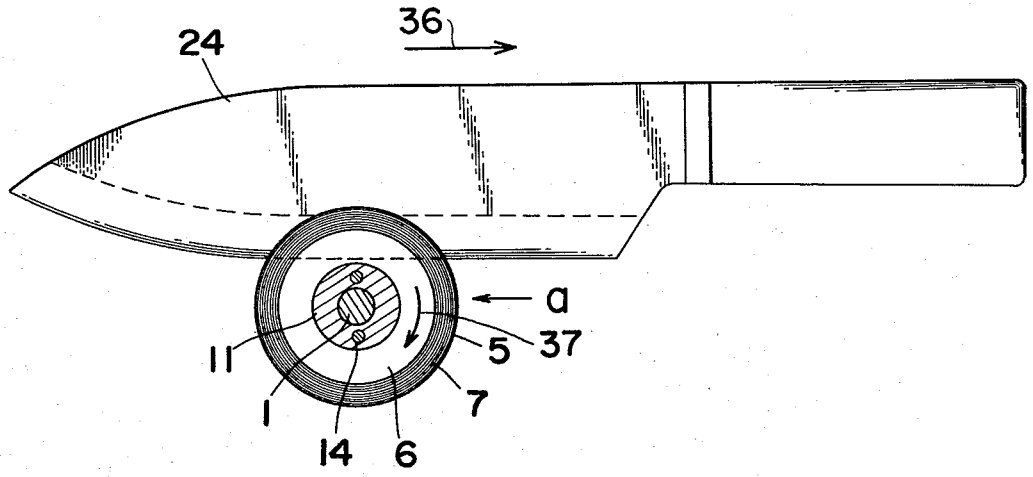
FIG. 3 is a cross sectional view along the line I — I of FIG. 1 with a knife associated with the invention.
Figure 5:
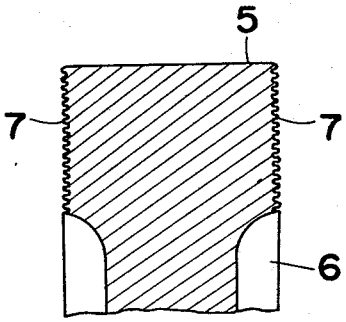
FIG. 5 is an enlarged cross sectional side view of an essential portion of a circular grinding plate.

Reference letter *a* represents a grinding wheel comprising a circular grinding plate 5 made of hardened special steel having concave portions 6 at the center portions of both sides thereof as shown in FIGS. 3 and 5. A plurality of concentric triangular projections 7 spaced apart from each other are provided at both sides of said circular grinding plate 5 other than said concave portions 6. Said circular grinding plate 5 also has a center hole 8 and small holes 9 at upper and lower positions thereof with respect to said center hole 8. Said grinding wheel *a* also comprises guide disks 10 arranged at both sides of said circular grinding plate 5, each having an inclined outer circumferential surface 26 inclined toward the plate 5 for guiding the blade of a knife 24, having projections 11 at the center portions of the both sides thereof, having a center hole 12, and having small holes 13 at upper and lower positions thereof with respect to said center hole 12. Said plate 5 and guide disks 10 are assembled together by inserting pins 14 into said small holes 9 and 13. Between said plate 5 and each guide disk 10 is provided a clearance space 15 of such a width that the blade of the knife 24 for use in a butcher's shop or the like is prevented from contacting with said projection 11 through said clearance space 15 when the knife 24 is pressed down.

Figure 2:
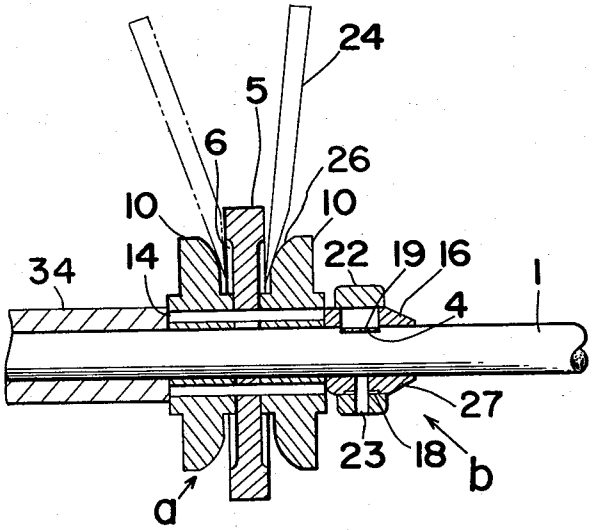
FIG. 2 is a cross sectional front view of an essential portion of the embodiment.
Figure 4:
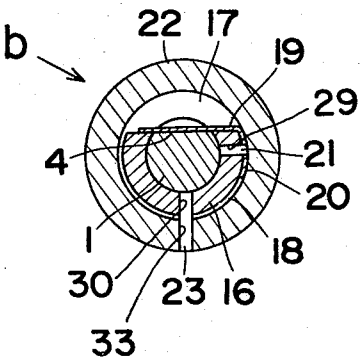
FIG. 4 is a cross sectional view along the line II — II of FIG. 1.

Reference letter *b* represents a stop comprising a cylindrical body 16 having an inclined outer peripheral surface 27 at its end, a center hole 28 and a circumferential groove 18. A cutout portion 17, which communicates with center hole 28 as FIGS. 2 and 4 show, and two small holes 29 and 30 are provided on body 16 in said groove 18. A plate spring 19 is attached at said cutout portion 17 and fixed on said cylindrical body 16 by inserting a pin 21 into one of said small holes 29 provided in said groove 18 through a hole 38 in an arcuate base portion 20 of said plate spring 19. Said cylindrical body 16 is inserted into a hole 31 in a hollow cylindrical cover 22 having a knurled outer peripheral surface 32 and fixed thereto by inserting a pin 23 into the other of said small holes 30 through a hole 33 in the cylindrical cover 22. Said supporting rod 1 is inserted into the hole 12 of the guide disk 10 arranged at the left side of the plate 5, the hole 8 of the plate 5, the hole 12 of the guide disk 10 arranged at the right side and the hole 28 of the cylindrical body 16, in this order, and the plate spring 19 is engaged with the notch portion 4 of the supporting rod 1 to thereby secure the grinding wheel *a* on the supporting rod 1 against the end of a hollow sleeve or abutment 34 which is disposed on supporting rod 1, thereby preventing axial displacement of the grinding wheel *a* while permitting axial rotation thereof.

The device arranged as above is used as follows.

The handle 3 of the device is grasped by one hand and the handle of the knife 24 by the other hand. As shown in a solid line in FIG. 2, the knife blade is put between the grinding plate 5 and the guide disk 10 disposed at the right side of the plate 5 to make the left side of the knife blade contacted with the right side surface of the grinding plate 5. Adding downward pressure to the handle of the knife 24, the knife 24 is drawn in the direction of arrow 36 shown in FIG. 3. During the sliding operation the knife blade can be slid in the direction of arrow 36 with the rotating guide disk 10 and the grinding plate 5 rotating in the direction of arrow 37 shown in FIG. 3, thus allowing the left side (with respect to FIG. 2) of the knife blade to be ground a little by the triangular projections 7 of the plate 5 passing obliquely over the knife blade.

On the other hand, after the sliding operation of the knife 24 on one side is finished, the knife blade is then put between the grinding plate 5 and the other guide disk 10 disposed at the left side of the plate 5 as shown by a double dot-and-dash line in FIG. 2 and slid again as described above, thus permitting the right side of the knife blade to be ground a little by the triangular projections 7 of the grinding plate 5. Thereafter, this alternate sliding operation of the knife blade, first between the grinding plate 5 and the guide disk 10 and then between the grinding plate 5 and the other guide disk 10, is repeated an appropriate member of times, so that the knife blade can be reformed in a straight line toward its blade edge and at the same time both its sides can be ground a little thereby removing adhesives such as grease adhered thereto, thus allowing the knife blade to be again sharpened.

When the knife blade becomes substantially blunt due to lack of its being ground for a long time, the device is fixedly held by grasping the handle 3 of the device and pressing the forward end of the supporting rod 1 against, for example, a table. Then the sliding operation of the knife blade is accomplished under strong downward press.

When the grinding plate 5 becomes dull, it can be exchanged by disconnecting the plate spring 19 from the cutout portion 17 of the supporting rod 1 by rotating through about 180° the stop *b* together with the cylindrical cover 22 with respect to the supporting rod 1.

In the other embodiment of the present invention a projection is provided on the both sides of the grinding plate 5 so that a clearance 15 is formed between the guide disk 10 and the grinding plate 5, without providing the projection 11 on the guide disk 10.

What is claimed is:

1. A device for reforming and grinding the blade of a knife to be sharpened comprising:

a supporting rod;

a grinding plate;

means for mounting said grinding plate for rotation on said supporting rod;

said grinding plate having on at least one side thereof a concave portion and a plurality of concentric projections of triangular cross section located radially outward of said concave portion;

at least one guide disk;

means for mounting said guide disk for rotation on said supporting rod adjacent said one side of said grinding plate;

said guide disk having on the side thereof facing said grinding plate an outer circumferential surface inclined toward said grinding plate;

means between said grinding plate and said guide disk to maintain an axial clearance space between said guide disk and said plurality of concentric projections;

and means on said supporting rod for preventing axial displacement of said grinding plate and said guide disk.

2. A device according to claim 1 including means for connecting said grinding plate and said guide disk so that both rotate together.

3. A device according to claim 1 wherein said means on said supporting rod for preventing axial displacement of said grinding plate and said guide disk comprises abutment means on said supporting rod, a notch portion in said supporting rod spaced inwardly of an end of said supporting rod, and a removable stop on said supporting rod in releasable engagement with said notch portion, said grinding plate and guide disk being disposed between said abutment means and said stop and thereby prevented from being moved in an axial direction on said supporting rod.

4. A device according to claim 1 wherein said supporting rod is cylindrical and has a tapered end and wherein said stop comprises: a body having a rod-receiving hole therethrough and a cutout portion affording access to said rod-receiving hole in said body, and a plate spring connected to said body and extending through said cutout portion and through said notch portion in said supporting rod, said plate spring being engagable with said cutout portion of said supporting rod to prevent axial movement of said stop on said supporting rod, and said plate spring being movable outwardly from said notch portion of said supporting rod to permit axial movement of said stop when said body is rotated with respect to said supporting rod.

5. A device according to claim 4 further including a cover for said body, said cover having a hole for receiving said body, and means for securing said cover to said body so that rotation of said cover effects rotation of said body.

6. A device for reforming and grinding the blade of a knife to be sharpened comprising:

a supporting rod;

a grinding plate;

means for mounting said grinding plate for rotation on said supporting rod;

said grinding plate having on each opposite side thereof a concave portion and a plurality of concentric projections of triangular cross section located radially outward of said concave portion;

a pair of guide disks;

means for mounting said guide disks for rotation on said supporting rod adjacent opposite sides of said grinding plate;

each of said guide disks having on the side thereof facing said grinding plate an outer circumferential surface inclined toward said grinding plate;

means between said grinding plate and said guide disks to maintain an axial clearance space between each of said guide disks and said plurality of concentric projections on a side of said grinding plate;

and means on said supporting rod for preventing axial displacement of said grinding plate and said guide disks.

7. A device according to claim 6 including means for connecting said grinding plate and said guide disks so that all rotate together.

8. A device according to claim 6 wherein said means on said supporting rod for preventing axial displacement of said grinding plate and said guide disks comprises abutment means on said supporting rod, a notch portion in said supporting rod spaced inwardly of an end of said supporting rod, and a removable stop on said supporting rod in releasable engagement with said notch portion, said grinding plate and guide disks being disposed between said abutment means and said stop and thereby prevented from being moved in an axial direction on said supporting rod.

9. A device according to claim 8 wherein said supporting rod is cylindrical and has a tapered end and wherein said stop comprises: a body having a rod-receiving hole therethrough and a cutout portion affording access to said rod-receiving hole in said body, and a plate spring connected to said body and extending through said cutout portion and through said notch portion in said supporting rod, said plate spring being engagable with said cutout portion of said supporting rod to prevent axial movement of said stop on said supporting rod, and said plate spring being movable outwardly from said notch portion of said supporting rod to permit axial movement of said stop when said body is rotated with respect to said supporting rod.

10. A device according to claim 9 further including a cover for said body, said cover having a hole for receiving said body, and means for securing said cover to said body so that rotation of said cover effects rotation of said body.

11. A device for reforming and grinding the blade of a knife to be sharpened comprising:

a cylindrical supporting rod having a tapered end;

a grinding plate;

means for mounting said grinding plate for rotation on said supporting rod;

said grinding plate having on each opposite side thereof a concave portion and a plurality of concentric projections of triangular cross section located radially outward of said concave portion;

a pair of guide disks;

means for mounting said guide disks for rotation on said supporting rod adjacent opposite sides of said grinding plate;

each of said guide disks having on the side thereof facing said grinding plate an outer circumferential surface inclined toward said grinding plate;

means for releasably connecting said grinding plate and said guide disks so that all rotate together;

means between said grinding plate and said guide disks to maintain an axial clearance space between each of said guide disks and said plurality of concentric projections on a side of said grinding plate;

and means on said supporting rod for preventing axial displacement of said grinding plate and said guide disks;

said last-recited means comprising:

abutment means in the form of a sleeve on said supporting rod, a notch portion in said supporting rod spaced inwardly of said tapered end of said supporting rod, and a removable stop on said supporting rod in releasable engagement with said notch portion, said grinding plate and guide disks being disposed between said abutment means and said stop and prevented thereby from being moved in an axial direction on said support, said stop comprising:

a cylindrical body having an axially extending rod-receiving hole therethrough and a circumferential exterior groove, a cutout portion in said groove affording access to said rod-receiving hole in said body, a plate spring connected to said body and extending through said cutout portion and through said notch portion in said supporting rod, said plate spring being engagable with said cutout portion of said supporting rod to prevent axial displacement of said stop, and said plate spring being disengagable from said cutout portion of said supporting rod when said body is rotated with respect to said supporting rod to permit axial removal of said stop, a cover for said body having a cylindrical hole for receiving said cylindrical body, and means for securing said cover to said body so that rotation of said cover effects rotation of said body.

* * * * *